US009303500B2

(12) United States Patent
Schneider et al.

(10) Patent No.: US 9,303,500 B2
(45) Date of Patent: Apr. 5, 2016

(54) METHOD FOR INITIATING CIRCULATION FOR STEAM ASSISTED GRAVITY DRAINAGE

(71) Applicant: RESOURCE INNOVATIONS INC., Calgary (CA)

(72) Inventors: Fred Schneider, Calgary (CA); Greg Kuran, Calgary (CA); Lynn P. Tessier, Eckville (CA)

(73) Assignee: R.I.I. NORTH AMERICA INC, Calgary (CA)

( * ) Notice: Subject to any disclaimer, the term of this patent is extended or adjusted under 35 U.S.C. 154(b) by 571 days.

(21) Appl. No.: 13/677,961

(22) Filed: Nov. 15, 2012

(65) Prior Publication Data

US 2013/0118737 A1 May 16, 2013

Related U.S. Application Data

(60) Provisional application No. 61/560,367, filed on Nov. 16, 2011.

(51) Int. Cl.
*E21B 43/24* (2006.01)

(52) U.S. Cl.
CPC ..... *E21B 43/2406* (2013.01); *E21B 43/2405* (2013.01)

(58) Field of Classification Search
CPC ..... E21B 3/2406
See application file for complete search history.

(56) References Cited

U.S. PATENT DOCUMENTS

| | | | | |
|---|---|---|---|---|
| 4,344,485 | A * | 8/1982 | Butler | 166/271 |
| 8,464,792 | B2 * | 6/2013 | Burnham et al. | 166/272.1 |
| 2006/0118305 | A1 * | 6/2006 | East et al. | 166/308.2 |
| 2008/0135241 | A1 * | 6/2008 | Iqbal et al. | 166/266 |
| 2009/0283263 | A1 * | 11/2009 | Sponchia | 166/252.1 |
| 2010/0065268 | A1 * | 3/2010 | Gates et al. | 166/268 |
| 2010/0163229 | A1 * | 7/2010 | Nenniger | 166/272.3 |
| 2010/0243249 | A1 | 9/2010 | Fang et al. | |

FOREIGN PATENT DOCUMENTS

WO WO 99/067503 12/1999

OTHER PUBLICATIONS

PCT/CA2012/050810 International Search Report and Written Opinion.

* cited by examiner

*Primary Examiner* — John Kreck
(74) *Attorney, Agent, or Firm* — Goodwin Law; Sean W Goodwin

(57) ABSTRACT

A method for initiating steam assisted gravity drainage (SAGD) mobilization and recovery of hydrocarbons in a hydrocarbon-bearing formation includes initially forming a circulation path by connecting SAGD injection well and a circulation well. The circulation well can be a SAGD production well or a separate well completed adjacent a toe of the injection well. Initially, a thermal carrier such as steam or flue gases, is circulated, forming a thermal chamber about the injection well. One initial start-up is complete, the circulation path is decoupled for further propagating the thermal chamber and establishing steady-state SAGD operations.

14 Claims, 14 Drawing Sheets

METHOD FOR INITIATING CIRCULATION FOR STEAM ASSISTED GRAVITY DRAINAGE

CROSS RELATED APPLICATION

This application claims the benefits under 35 U.S.C 119(e) of U.S. Provisional Application Ser. No. 61/560,367, filed Nov. 16, 2011, which is incorporated fully herein by reference.

FIELD

Embodiments disclosed herein generally relate to methods and systems for initiating steam circulation between horizontally extending, generally parallel and adjacent wells, such as those for a steam assisted gravity drainage (SAGD) well-pair.

BACKGROUND

With reference to FIG. 1 and as commonly known in the industry, steam assisted gravity drainage (SAGD) uses a well-pair of closely coupled, horizontally-extending, generally parallel wells comprising a first steam injection well (injection well) and a second production well (production well) spaced and positioned below the injection well. Typically, SAGD is commenced in a start-up phase by independently and simultaneously circulating steam through both the injection well and the production well. Steam is injected through a tubing string which extends to a toe of each of the injection well and the production well. The injected steam condenses in each well, releasing heat and creating a liquid phase which is removed through the casing-tubing annulus in the opposite direction of the injected steam.

The released heat is conducted initially through an intervening portion of the formation between the injection well and the production well (inter-well region) and then through the formation to sufficiently heat and otherwise mobilize bitumen therein to cause the heated bitumen to flow by gravity drainage into the production well. In this start-up phase, a thermal chamber is created between the injection well and production well as the mobilized bitumen gravity drains into the production well.

After a well-to-well steam communication of is achieved, steam is injected continuously into the upper injection well and condensate and heated oil are removed from the lower production well.

This start-up of SAGD has been enhanced to date through various known techniques including cold water dilation, steam dilation, solvent soaking and electrical heating for reducing the time required for establishing communication between the injection well and the production well. In cold water and steam dilation, cold water or steam is injected into the inter-well region for creating a vertical dilation zone and increasing porosity, permeability and water saturation of the inter-well region.

In solvent soaking, a solvent is injected into the inter-well zone and allowed to soak prior to steaming. The solvent mixes with the bitumen therein and reduces the viscosity of the bitumen allowing the bitumen to be mobilized at a lower temperature.

In electrical heating techniques, an electrical downhole heater is placed in the wells for conducting heat into the inter-well region to reduce the viscosity of the bitumen therein.

As the mobilized bitumen drains into the production well, interstitial space voided by the mobilized bitumen forms a steam chamber which continues to grow horizontally and vertically. Simultaneous circulation of steam into both the injection well and the produce well (or SAGD start-up) is ceased when the steam chamber reaches the production well, and ramp-up of SAGD can begin.

During ramp-up, steam in injected into the injection well only, at a constant pressure for mobilizing heavy oil above the injection well for continued gravity drainage and recovery at the production well.

Factors dictating the success or timeliness of enhanced oil recovery of hydrocarbon-bearing formations include the transport of thermal or drive mechanisms into the formation for enhanced oil recovery (EOR). Often, primary extraction of hydrocarbons leaves areas of voidage, wormholes or other areas of high transmissibility conducive to introducing EOR mechanisms.

In formations generally deemed suitable for SAGD, such as previously un-exploited formations, the initial transport conditions for steam, solvent or other transmission means are slow to initiate and can retard the development of a thermal mobilization chamber. Further, to date, each well-pair of a field of well-pairs is treated independently without consideration or advantage of adjacent well-pairs.

Regardless of the mechanism, there is an opportunity to improve initiating circulation for steam assisted gravity drainage and inter-well communication between injection and production wells.

SUMMARY

Generally, in embodiments disclosed herein, the initial formation of a SAGD thermal chamber is hastened by establishing a uni-directional thermal stimulation circulation path between the injection well and a circulation well, either from heel-to-toe or toe-to-heel.

In embodiments, inter-well-pair communication is established for initiating the uni-directional thermal stimulation circulation path from the heel of the injection well towards the toe for return via a circulation well, such as the production well, for thermal stimulation and rapid initial formation of the steam-solvent chamber before transitioning into more conventional well-pair SAGD injection and production. Such inter-well communication is established at one or more locations along their length such as through one or several processes including fracturing, intersecting the well-pair during drilling or back-reaming from the toe of each well with overlapping of the reamed areas. An inter-well connection between the injection well and production well, adjacent their respect toes of the well-pair maximizes the circulation path.

Alternative embodiments establish a toe-to-heel circulation by initially completing a circulation well, such as a thermal well completed adjacent the toe of the SAGD injection well, for initially establishing the thermal stimulation circulation path such as between the thermal well and along the SAGD injection well towards the surface.

Once the uni-directional thermal stimulation circulation path is developed, the thermal energy applied to the initial circulation can be provided via a thermal carrier such as steam, steam-solvent, or other thermal mechanisms.

Besides steam-based thermal mechanisms, other thermal sources can include a downhole steam generator, burner or form thereof including Applicant's co-pending patent application entitled for Apparatus and Methods for Downhole Steam Generation and Enhanced Oil Recovery (EOR) (filed Jan. 14, 2010 in Canada as serial number 2,690,105 and in the United States published Jul. 22, 2010 as US 2010/0181069 A1, the entirety of both of which are incorporated herein by reference). Applicant also refers to the process of downhole generation as STRIP™, a trademark of Resource Innovations Inc., Calgary, Canada.

Accordingly, in another embodiment, combustion products are circulated along at least the injection well. A combustion source can be located for access to the injection well, flowing heated combustion products along the injection well from heel-to-toe or toe-to-heel. Similarly, as in other circulation strategies disclosed above, the combustion products can be injected through generation thereof in the injection well itself or from a thermal well completed adjacent the toe thereof. Non-condensable combustion products are vented from the other of the injection well or the production well not having the combustion source. The venting can include pressure control.

In the case of a field of two or more adjacent and generally parallel SAGD well-pairs, the additional thermal energy through the injection of combustion products can influence and mobilize a more significant portion of the reservoir between well-pairs. In embodiments utilizing a thermal well, one thermal well can be completed to service or establish inter-well communication with several SAGD well-pairs.

In a broad aspect, a method for initiating SAGD mobilization and recovery of hydrocarbons in a hydrocarbon-bearing formation involves drilling a SAGD well-pair comprising an injection well having a first heel, a first toe and a first horizontally-extending portion therebetween, a production well having a second heel, a second toe, and a second horizontally-extending portion therebetween, initially establishing a thermal circulation path along at least a portion of the injection well's horizontally-extending portion during a start-up phase; and thereafter establishing either a ramp-up or a conventional SAGD operation.

In another aspect, a method for initiating SAGD mobilization and recovery of hydrocarbons in a hydrocarbon-bearing formation comprises completing a SAGD well-pair into the formation, the well-pair having an injection well arranged generally parallel to, and spaced above, a production well, the injection well having a toe and once completed, establishing a uni-directional thermal stimulation circulation path along the injection well by connecting the injection well to a circulation well. One then circulates a thermal carrier between the injection well and circulation well, forming an initial thermal chamber along at least a portion of the injection well. The thermal chamber mobilizes the hydrocarbons for recovery from the production well.

In various aspects, initially establishing thermal circulation comprises one or more of: forming an uni-directional thermal flow path along the injection well's horizontally-extending portion, in one embodiment from heel-to-toe, in another from toe-to-heel, or forming an inter-well thermal circulation path between the first and second horizontally-extending portions for, establishing an initial thermal chamber between the first and second horizontally-extending portions at the inter-well communication path, establishing steady state injection of thermal energy for growing the initial thermal chamber, or completing a thermal well adjacent the first toe and establishing communication therewith for establishing a thermal flow path along the first horizontally-extending portion in either direction and thereafter interrupting the circulation flow path; and mobilizing the hydrocarbons and recovering the hydrocarbons from the production well in a SAGD operation.

In other aspects, the source of thermal energy for conducting along the thermal flow path is steam, combustion products or steam formed from the interface of combustion products and injected water. Combustion products, such as flue gases from downhole combustion, can be generated using a downhole burner located in the injection well or in a thermal well adjacent the first toe with recovery of at least some of the non-condensable combustion products of the thermal well or injection well respectively.

DETAILED DESCRIPTION

Embodiments herein enhance the start-up phase of prior art SAGD operations and establish a uni-directional thermal stimulation circulation path P along the injection well and a circulation well, either by creating a substantially direct inter-well connection with the production well or introducing a new thermal well adjacent the toe of the injection well for communication therewith. The uni-directional thermal stimulation circulation path P for removing the liquid phase, condensate or emulsion created by the steam as it heats the bitumen in the formation. Thermal energy can be applied via steam, or a downhole burner. A downhole burner can further enhance production from even depleted-SAGD formations.

During completion of a SAGD well-pair, or thereafter, the injection well can be connected to a circulation well for forming a uni-directional thermal stimulation circulation flow path therealong. The circulation well either provides for the introduction of a thermal carrier or removal of the products therefrom. Products from the introduction of a thermal carrier can include condensate, emulsion and non-condensable components.

Figure 1:
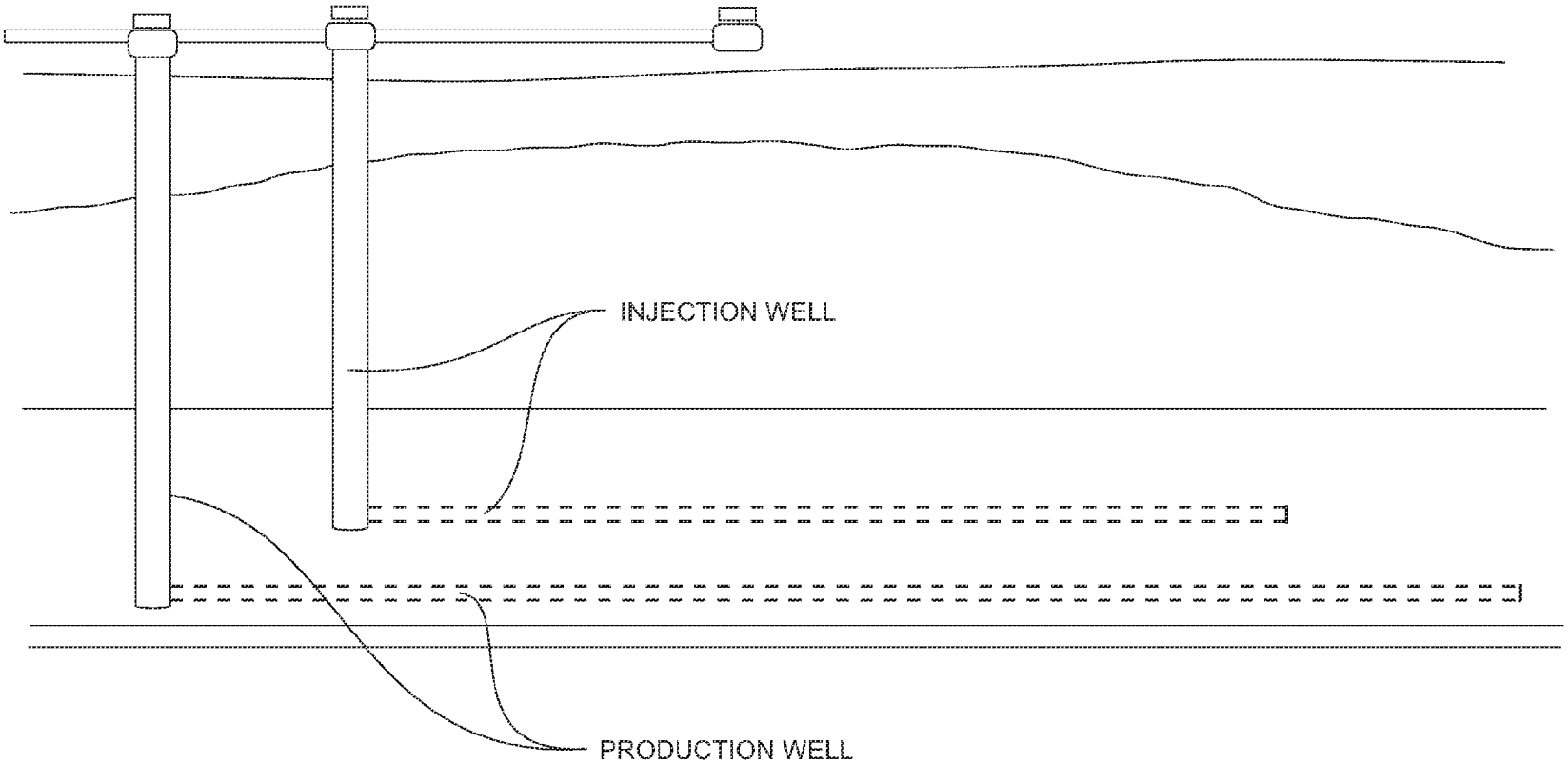
Fig. 1 PRIOR ART
FIG. 1 is a representative drawing of steam assisted gravity drainage (SAGD) system known in the prior art.
Figure 2:
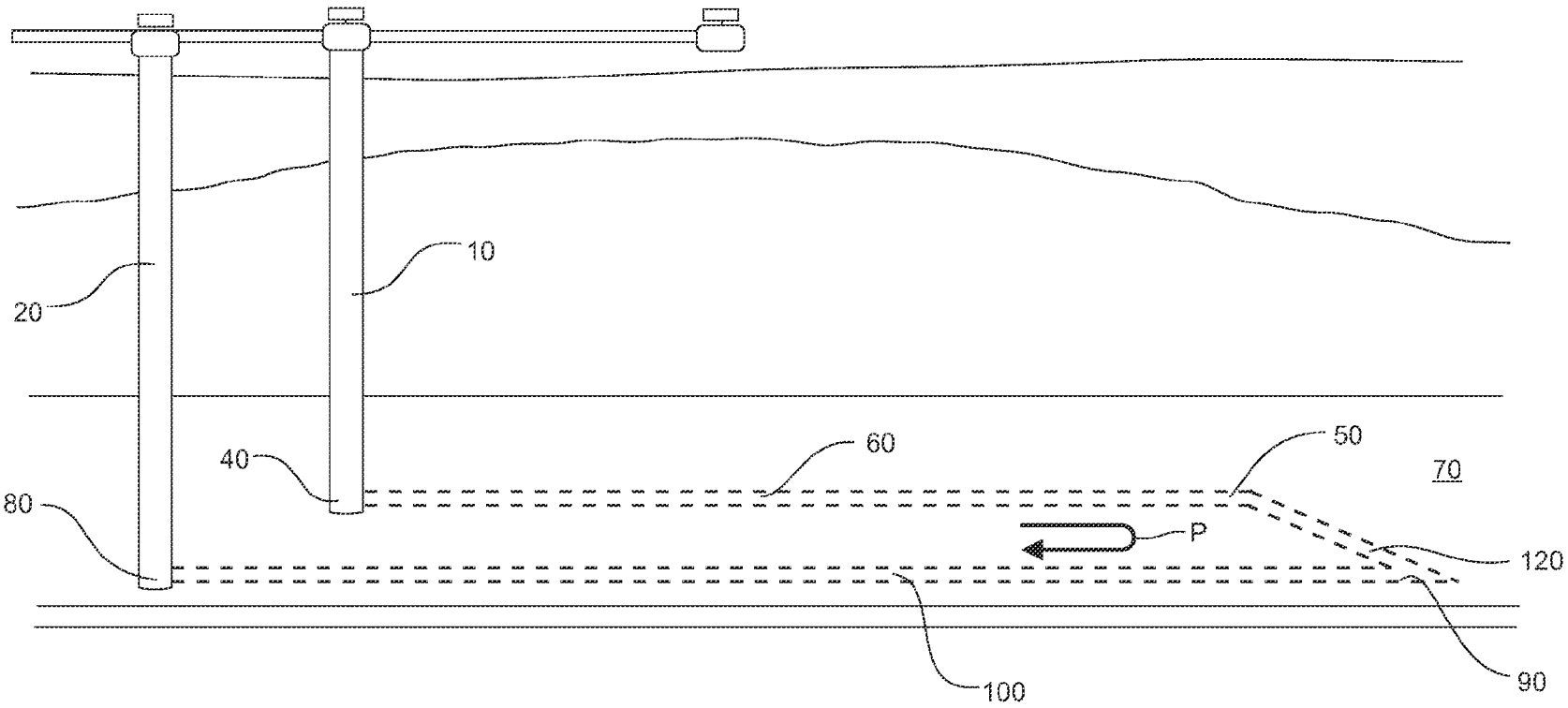
FIG. 2 illustrates a direct inter-well connection of a SAGD well-pair created by directionally drilling a toe of the injection well downwards to a toe of a corresponding production well.

With reference to FIG. 2, one embodiment can comprise establishing a substantially direct connection between a well-pair of an injection well 10 and a production well 20, as the circulation well, from which an initial thermal chamber can be developed.

A SAGD well-pair is completed, as shown, by drilling the injection well 10, comprising a first heel 40, a first toe 50 and a first horizontally-extending portion 60 therebetween, from surface into a hydrocarbon-bearing formation 70. Similarly, the production well 20, comprising a second heel 80, a second toe 90 and a second horizontally-extending portion 100 therebetween, is drilled, such that the second horizontally-extending portion 100 is substantially parallel to and spaced below the first horizontally-extending portion 60.

In an embodiment, a direct connection 120 can be formed between the horizontally-extending portions 60,100 of the well-pair for quickly establishing inter-well communication between the injection well 10 and the production well 20, and the thermal stimulation circulation path P permitting direct circulation of thermal energy between at least a portion of the horizontally-extending portions of the injector well 10 and a circulation well, in this instance, the production well 20. Although FIG. 2 illustrates the substantially direct inter-well connection 120 being formed at about the toes 50,90 of injection-production well-pair, Applicant notes that the substantially direct inter-well connection 120 is located somewhere along and between the horizontally-extending portions 60,100 of the respective injection well 10 and production well 20. For the purposes of this application, the inter-well connection 120 will be illustrated at being adjacent the toes 50,90 of the horizontally extending portions 60,100 of the injection and production wells 10,20 maximizing the effective length of the horizontally-extending portion 60 of the injection well 10.

Figure 3:
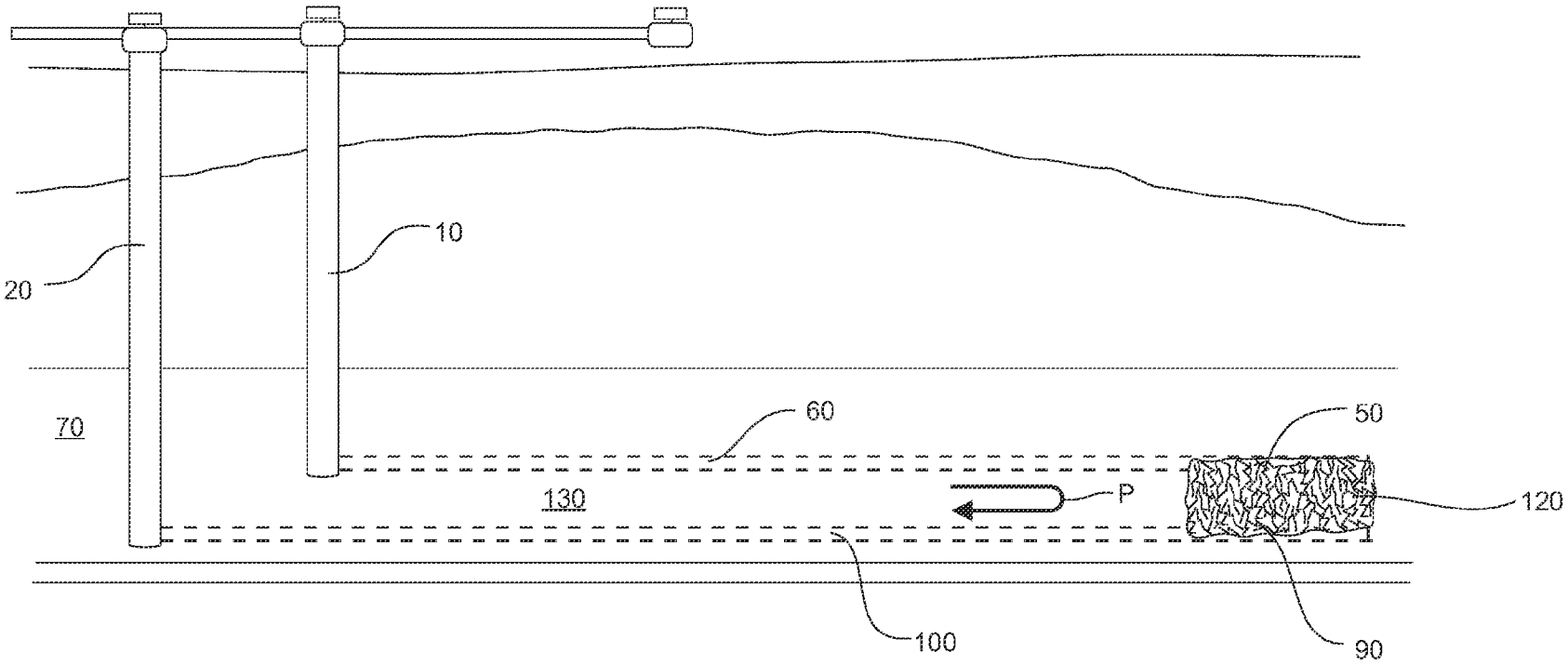
FIG. 3 illustrates a direct inter-well connection of a SAGD well-pair created by fracturing an inter-well region between a toe of an injection well and a toe of a production well.

With reference to FIG. 3, and in one embodiment, the direct inter-well connection 120 can be formed by fracturing an inter-well region or intervening portion 130 of the formation 70 between the horizontally-extending portions 60,100 of the well-pair. In an embodiment, and as shown, the fracturing can be conducted in at least one of the toes 50 or 90 of the horizontal well-pair to the other. Applicant believes that, due to the close proximity or well spacing in SAGD well-pairs, typically in the order of 5 meters, fracturing would preferentially occur between the injection well 10 and the production well 20 of each well-pair, creating the substantially direct connection 120, connections or pathways P for the thermal mechanism to propagate through the formation 70.

In another embodiment, the direct connection 120 can be formed by directional drilling through the intervening portion 130 of the formation 70 between the two horizontally-extending portions 60,100, such that the horizontally-extending portions 60,100 intercept one another. Referring back to FIG. 2, the first toe 50 of the first horizontally-extending portion 60 can be sloped downwards during drilling to extend and intercept the second horizontally-extending portion 100.

Figure 4:
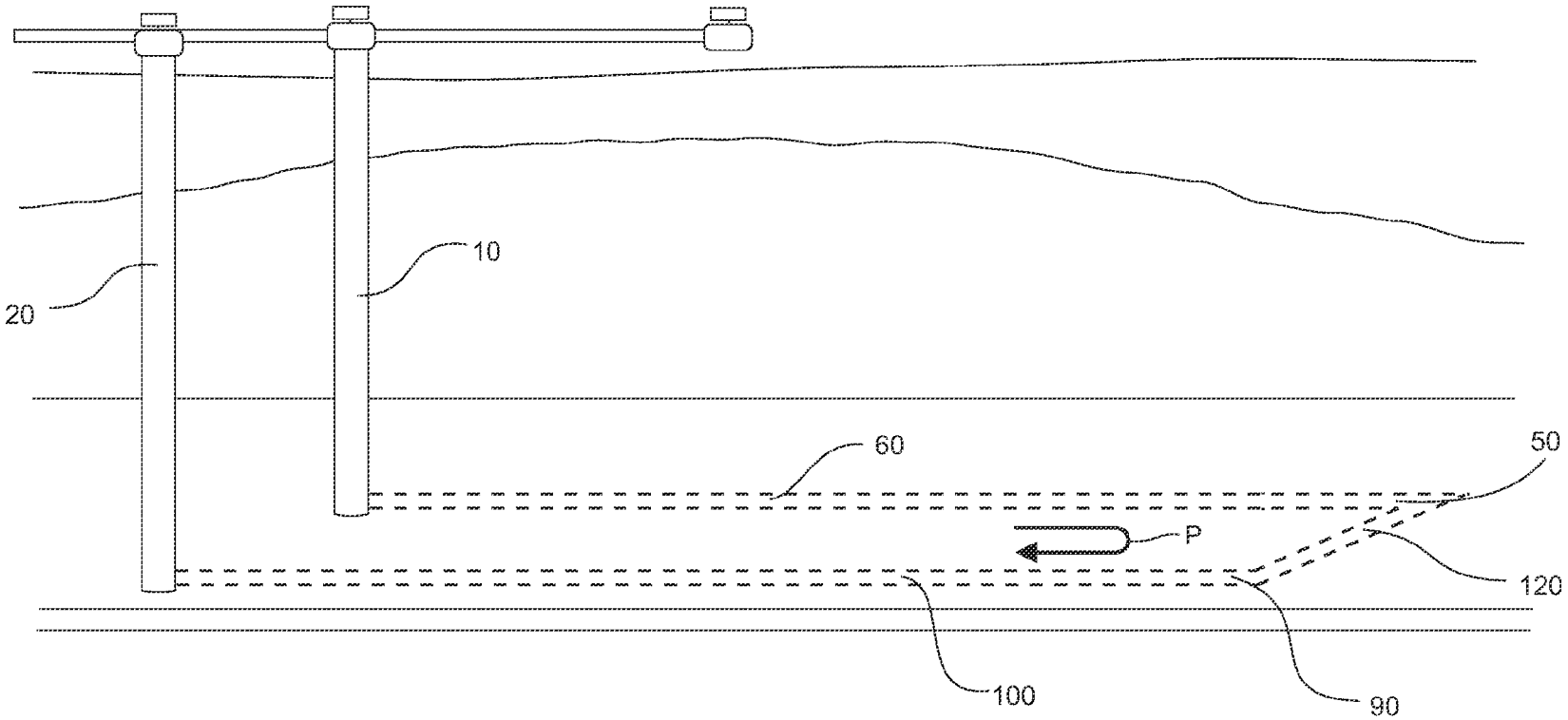
FIG. 4 illustrates a direct inter-well connection path of a SAGD well-pair created by directionally drilling a toe of a production well upwards to intercept a toe of a corresponding injection well.

With reference to FIG. 4, similarly, in another embodiment, the toe 90 of the second horizontally-extending portion 100 can be sloped upwards during drilling to extend and intercept the first horizontally-extending portion 60.

The intersection of the injection well 10 and the production well 20 establishes a direct or a substantially direct connection 120 and the circulation path P.

Figure 5:
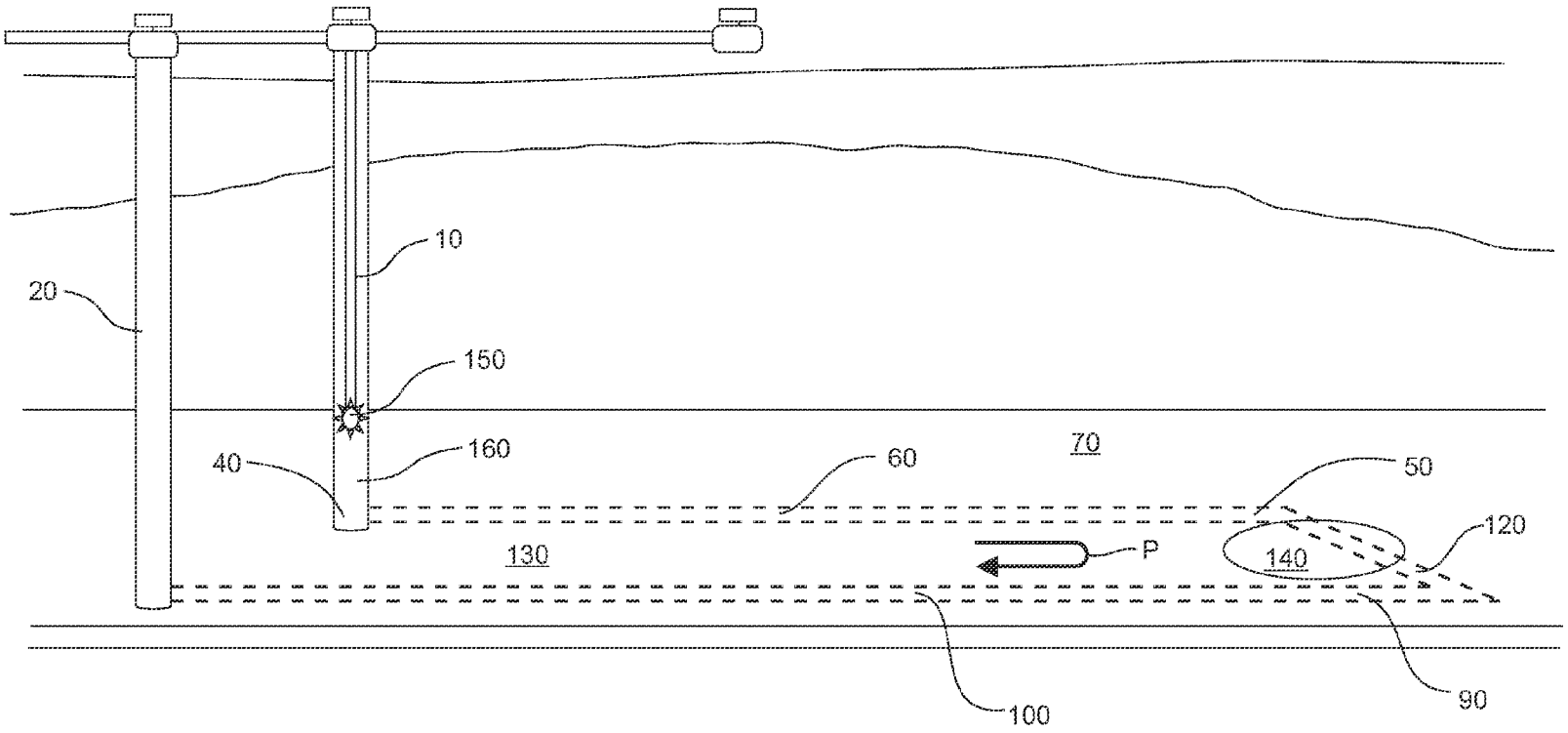
FIG. 5 illustrates a downhole burner positioned at a heel of the injection well and formation of an initial thermal chamber created by the circulation of a thermal carrier from the injection well to the production well, the thermal chamber being about the inter-well connection.

With reference to FIG. 5, once the inter-well connection 120 is established, an initial thermal chamber 140 is created by the circulation of a thermal carrier. In an embodiment, thermal energy can be injected or conducted down the injection well 10 via the injection of the thermal carrier, such as steam or, as shown in an alternate embodiment, through the discharge of hot flue gases from a downhole burner 150 positioned at about the first heel 40 of the injection well 10. The thermal carrier, commonly in the form of steam, either from the surface or from an in-situ steam generator, or hot flue gases from a burner, either located on the surface of positioned downhole, can be circulated through from the injection well 10 through the thermal chamber 140 and to the production well 20. During the circulation of the thermal carrier, steam condenses and water and emulsion is pumped from the production well 20. In the case of a burner, non-condensable materials and exhaust gases can be vented through the production well 20 simply as part of the thermal stimulation circulation path.

In an embodiment, and as shown, a downhole burner 150 can be positioned in a vertical portion 160 adjacent the first heel 40 of the injection well 10 for generating hot flue gases which can be circulated through the thermal stimulation circulation path P created between a well-pair to heat up, dissolve or otherwise mobilize oil surrounding the well-pair.

Further as shown in FIG. 5, and in an embodiment using a steam generator, such as Applicant's generator disclosed in US Published Patent Application Serial No. 2010/0181069, at least hot flue gases, and associated heat into the formation, can be positioned at about the first heel 40 of the injection well 10 and operated at steady state to conduct at least thermal energy and hot flue gases down the first horizontally-extending portion 60 for delivery of the hot flue gases and heat to the formation 70. The thermal energy from the heat and hot flue gases can be transferred to the intervening portion 130 of the formation 70 while the resulting excess non-condensable gases can be circulated and removed through the lower production well 20. The heat from the process also converts connate water or additional injected water to steam, adding a steam thermal mechanism. Oil mobilized heavy oil flows down into the production well 20 and can also co-mingle with excess flue gases which can provide a gas-lift hydraulic force to transport the mobilized oil to the surface.

Figure 6:
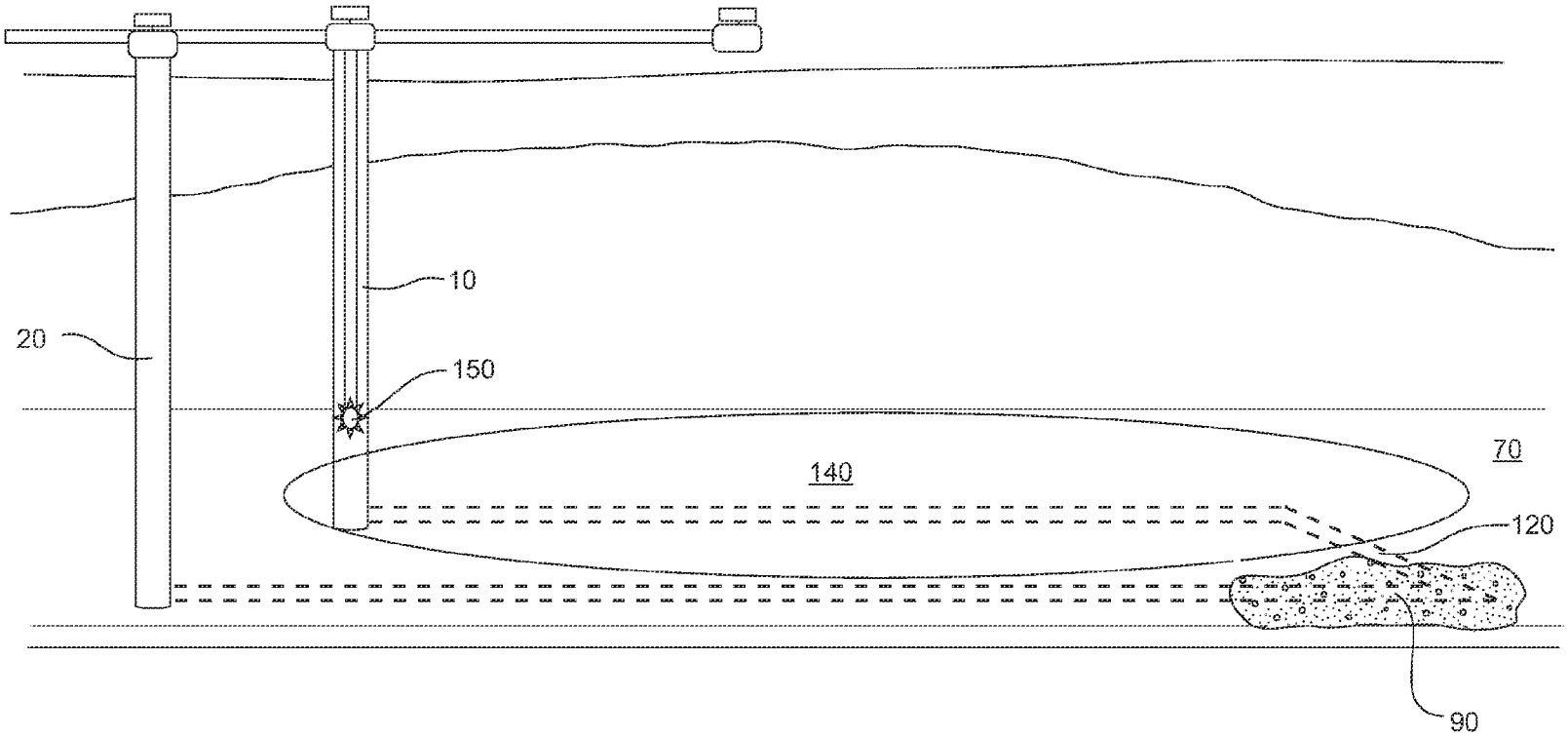
FIG. 6 illustrates the inter-well connection of FIG. 5 subsequently cemented or otherwise blocked for propagating the growth of a thermal chamber in steady-state SAGD operations.

With reference to FIG. 6, once start-up is completed and as the hydrocarbon-bearing formation 70 receives an increasing amount of thermal energy for heating up the bitumen and, as the thermal chamber 140 grows or propagates, the method is adjusted to focus more so on the matrix oil above the production well 20 and around the injection well 10. Accordingly, the circulation path P formed by the two wells 10,20 is decoupled for transition into a more conventional SAGD scenario or steady state operations by blocking the inter-well connection 120.

Steady-state operations resemble conventional SAGD operations. In the case of burner-supplied flue gases, one also has non-condensable $CO_2$ collecting in the bottom of the initial thermal chamber 140. The hot flue gases released into this chamber override the cooler $CO_2$ in flue gases which have lost thermal energy when they come into contact with an upper portion of the chamber walls. This process heats up and dissolves contacted bitumen, the mobilized liquid draining down the chamber walls for collection at the bottom of the chamber. Both the liquid and excess non-condensable vapors are produced from the bottom of this chamber.

In preparation for steady-state operations, the thermal injection process is temporarily suspended to permit cementing off or otherwise blocking one of either the injection well 10 or the production well 20 at about the inter-well connection 120. In an embodiment, and as shown in FIG. 6, the toe 90 of the production well 20 can be cemented off and plugged adjacent its toe 90. The production well 20 can be plugged by squeeze cementing to minimize preferential flow of thermal injection between the well-pair. In another embodiment, cementing and plugging off can occur in the injection well 10 about the inter-well connection 120. Further, in order to mitigate preferential flow around the plugged well, one could employ a cement squeeze into the formation preventing preferential flow of thermal injection between the well-pair through the space between the casing and formation.

As a result of the decoupling of the injection well 10 and the production well 20, and mobilized oil gravity draining into lower production well 20, growth of the thermal chamber 140 is expected to be generally radial in nature, from about the location of the substantially direct inter-well connection 120 towards the heels 40,80 of the well-pair.

Figure 7:
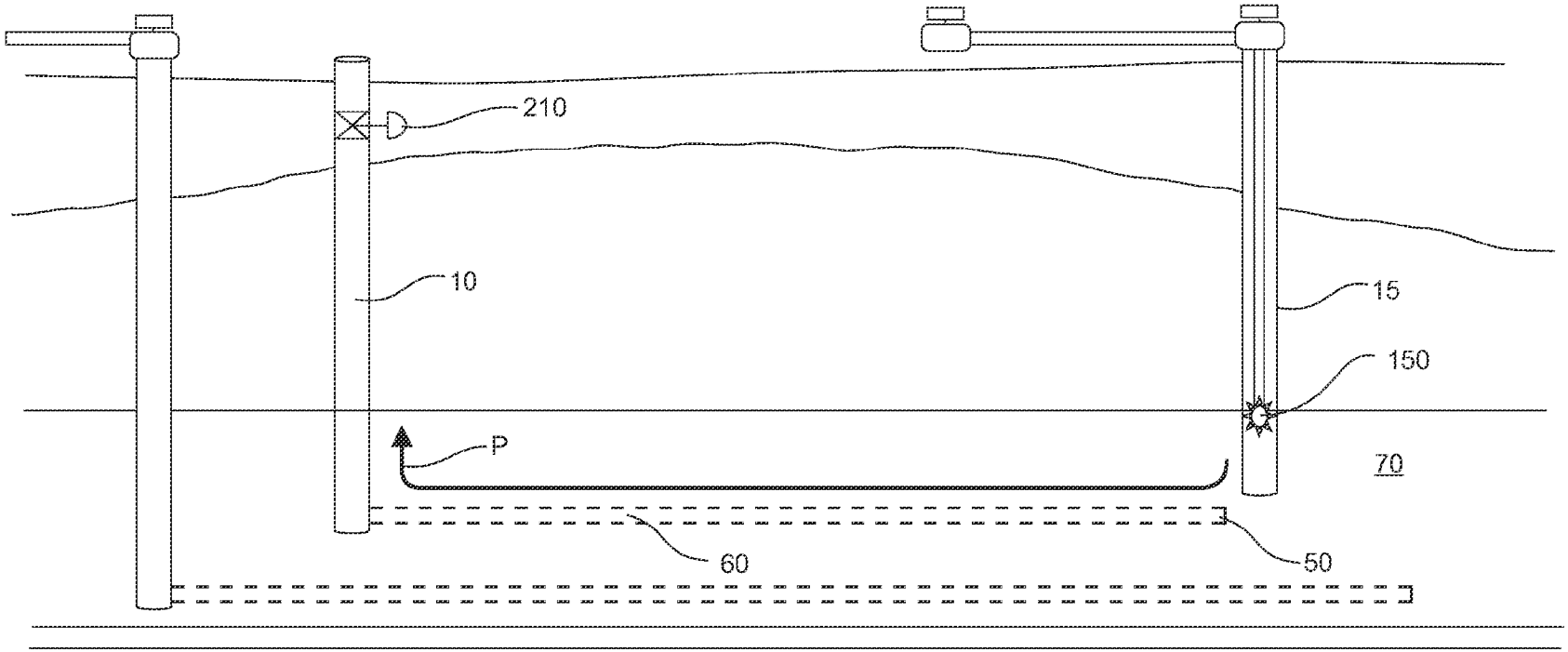
FIG. 7 illustrates a downhole burner positioned in a new thermal well adjacent a toe of a previously drilled injection well.

In an alternate embodiment, and as shown in FIG. 7, a new circulation well, such as a thermal well 15 can be drilled to position the downhole burner 150 at about the first toe 50 of the injection well 10. As shown in this embodiment, the thermal well 15 is vertical.

As shown, the thermal well 15 is created and a downhole burner 150 can be installed at about the first toe 50 of an injection well 10. The thermal well 15 can be landed sufficiently close enough to the upper injection well 10 to permit steam and/or solvent to break through and flow into the formation 70 via the first horizontally-extending portion 60 for creating the thermal stimulation circulation path P. The heat and/or solvent can travel down the first horizontally-extending portion 60 of the injection well 10, during which time heat and/or solvent can propagate into the surrounding formation 70. The combined affect mobilizes bitumen about the injection well 10. As a result, the injection well 10 can serve a dual function, firstly for creating the thermal stimulation circulation path P and secondly, as a vent for excess non-condensable gases.

Figure 8:
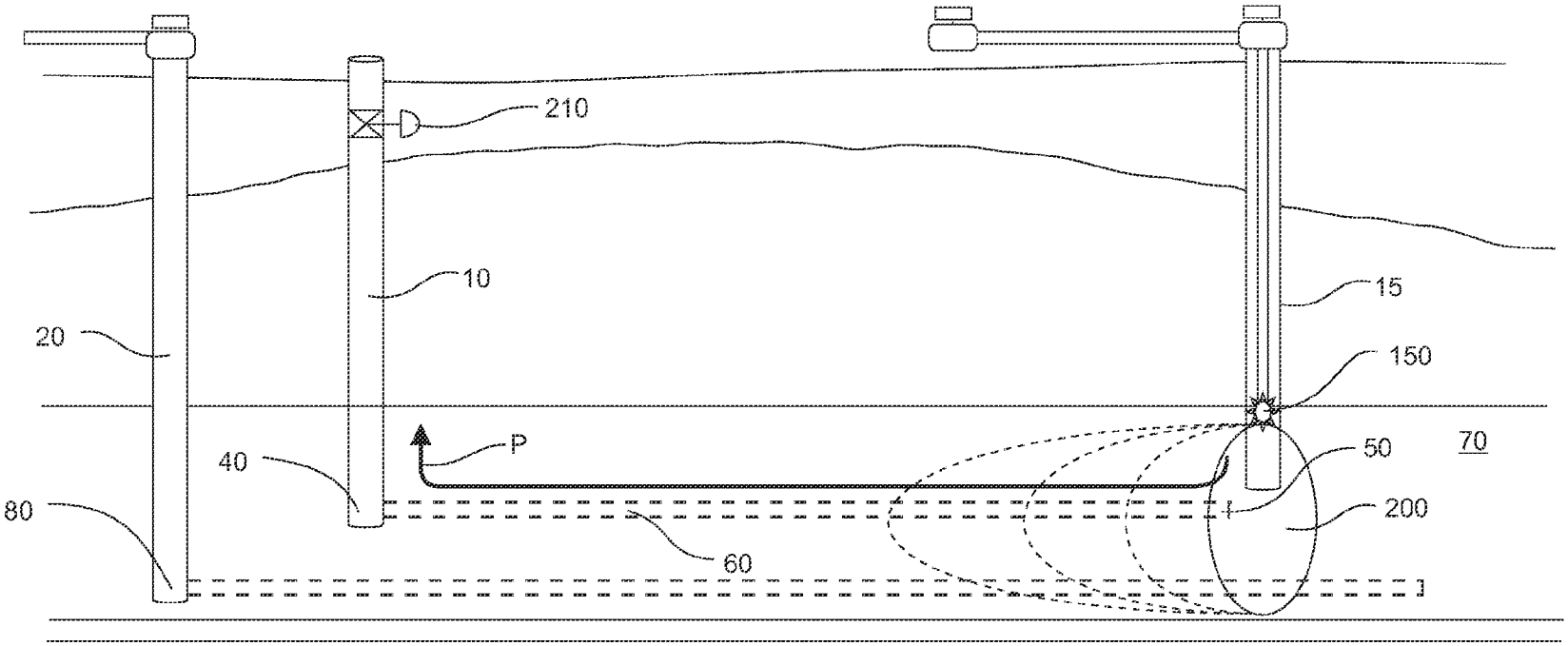
FIG. 8 illustrates a thermal chamber created by the downhole burner of the embodiment of FIG. 7, the thermal chamber being in communication with the injection well and intersecting the production well.

With reference to FIG. 8, the hot flue gases produced by the downhole burner 150 can be injected into the formation 70 and heat therefrom can propagate through the formation 70 surrounding the upper injection well 10 for mobilizing the bitumen therein and permitting gravity drainage and produced via the lower production well 20.

The downhole burner 150 further creates a thermal chamber 200 about the upper injection well 10 and steady state operation of the burner 150 causes the thermal chamber 200 to grows until it reaches the lower production well 20.

Over time the thermal chamber 200 grows to intersect the production well 20 and the area around the well-pair evolves into a conventional thermal chamber. The non-condensable gases preferentially flow from the first toe 50 to first heel 40 of the upper injection well 10.

Steady-state operation of the downhole burner 150 generates hot flue gases at about the thermal chamber 200 and enters the formation 70 at about the first toe 50 for permeating therethrough. As disclosed in Applicant Published US Patent Application 2010/0181069 (published on Jul. 22, 2010) steam is created within the formation 70 as injected water gravity drains into these the hot flue gases. The steam formed within the formation 70 surrounding the thermal chamber 200 likely follows the path of least resistance, and accordingly will likely flow into the first toe 50 of the upper injection well 10. This steam transports and conducts heat into the formation 70 about injection well 10 while non-condensable gasses are then produced at surface through the injection well 10.

The venting of flue gases enables mass flow of the thermal carrier along the injection well 10. To maintain pressure and prevent hot flue gases from immediately venting through the injection well 10, a pressure valve 210 can be positioned in the injection well 10 at the surface. As excess non-condensable gases are relieved at surface via the circulation path P, temperatures between the steam and bitumen can be controlled allowing for pressure management of the system. Such pressure management control allows an operator to control and manage the flows of thermal energy into the formation preferentially to bypassed or virgin areas.

Alternatively, the thermal well 15 can form the vent portion of the circulation path P and the burner located in the injection well 10 as illustrated earlier in FIG. 5. The additional of the thermal well replaces the inter-well connection 120 between the injection well 10 and the production well 20, allowing for an alternate enhanced start-up operation. Manipulating reservoir pressure also controls thermal propagation of the thermal chamber 200.

Figure 9A:
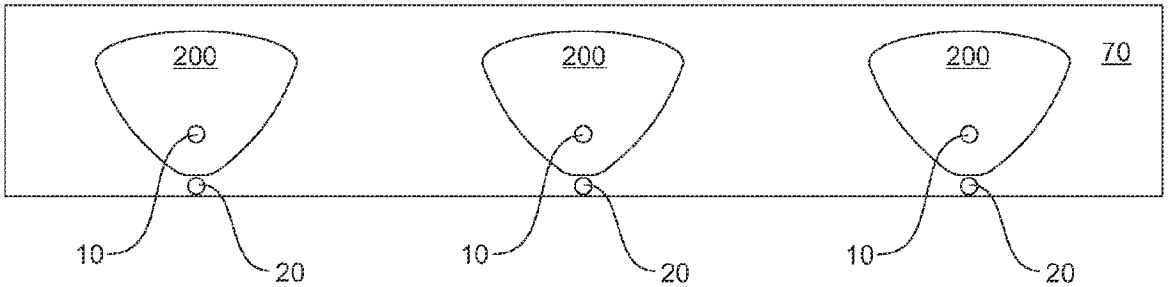
Fig. 9A PRIOR ART
FIG. 9A is a cross-sectional drawing of laterally spaced thermal chambers created from a conventional SAGD operation.
Figure 9B:
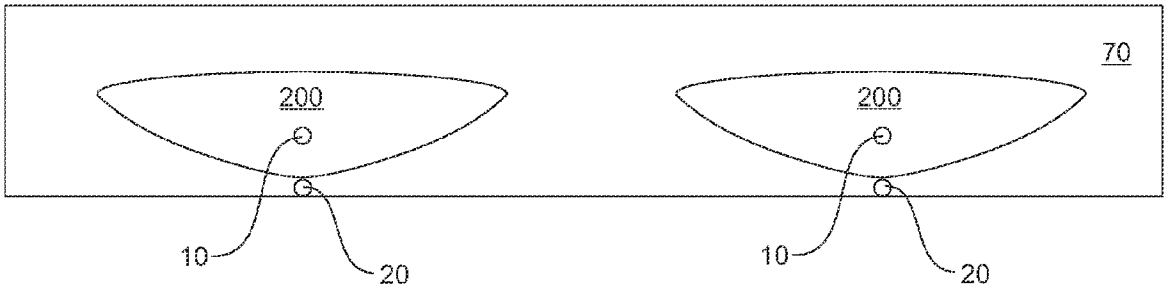
Fig. 9B PRIOR ART
FIG. 9B is a cross-sectional drawing of laterally spaced thermal chambers created from a conventional steam-solvent SAGD operation.
Figure 9C:
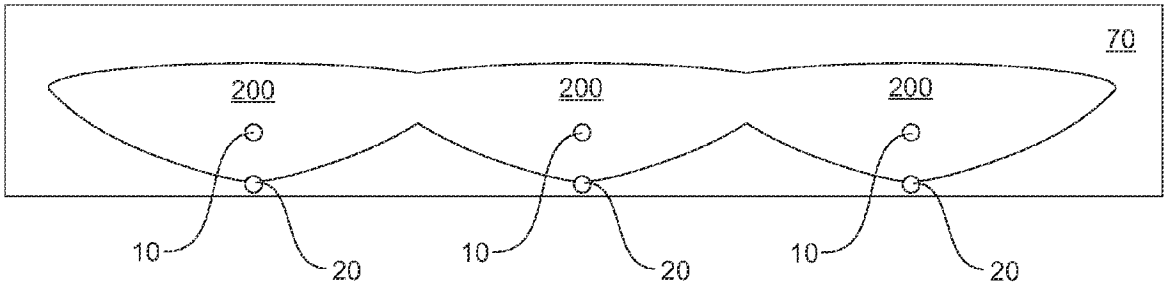
FIG. 9C is a cross-sectional drawing of laterally spaced thermal chambers created by the various embodiments described herein.

With reference to FIGS. 9A to 9C, Applicant believes that embodiments of the process disclosed herein result in a more efficient and greater extend of lateral growth or expansion of the thermal chamber 200 than that of the prior art.

As shown in FIG. 9A, conventional SAGD well-pairs are typically spaced apart by about 50 to 200 meters and the thermal chambers 200,200 created by adjacent SAGD well-pairs are separated by about 20 meters at its closest point. Similarly, as shown in FIG. 9B, steam-solvent SAGD well-pairs are typically spaced 100 to 400 meters apart, and thermal chambers 200,200 created by each well-pair are separated by about 30 meters at its closest point. As shown, the thermal chambers 200,200 of neither the conventional SAGD well-pair (FIG. 9A) nor the steam-solvent SAGD well-pair (FIG. 9B) intersect one another, resulting in a portion of the formation 70 that remains untouched.

With reference to FIG. 9C, well-pairs employing embodiments disclosed herein can be spaced apart by about 100 to 400 meters. However, the thermal chambers 200,200 created by embodiments disclosed herein laterally or horizontally expand within the formation 70 to intersect the thermal chamber created by an adjacent well-pair. The intersection of the thermal chambers 200,200 likely reaches all portions of the formation 70 for SAGD operations.

Figure 10:
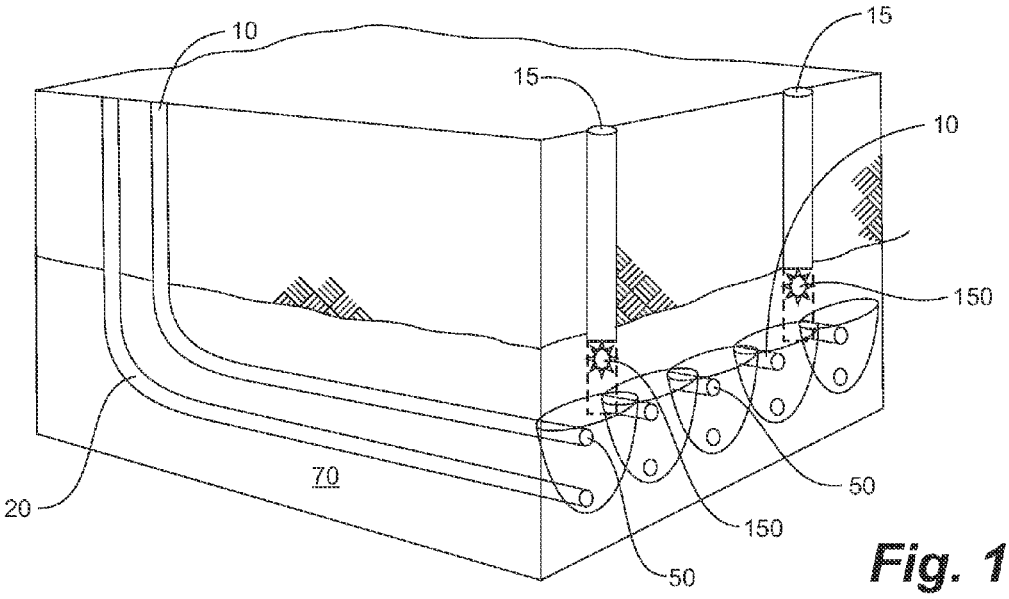
FIG. 10 is a perspective drawing of a formation having several thermal wells, each of which is positioned generally between a pair of SAGD well-pairs of a field of SAGD well-pairs.
Figure 11:
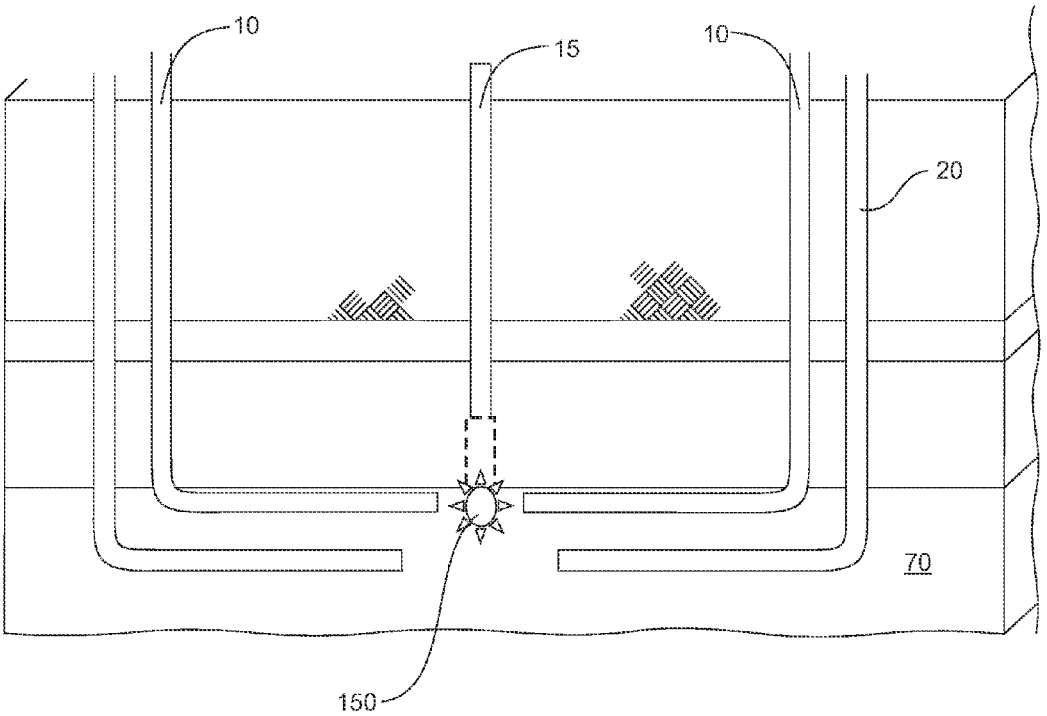
FIG. 11 an elevation view of embodiment of a formation having a thermal well positioned generally between the toes of facing SAGD well-pairs.

Thus, in an embodiment shown in FIGS. 10 and 11, a single thermal well 15 can be employed to sufficiently affect two or more previously drilled SAGD well-pairs. As shown, a single new thermal well 15 can be drilled to position the downhole burner 150 about and between the toes 50,50 of injection wells 10,10 of adjacent SAGD well-pairs 300 (see FIG. 10) or facing well-pairs (see FIG. 11).

It is known that typical conventional SAGD operations produce only about 30% of the original oil in place (OOIP), leaving approximately 70% OOIP in the formation for exploitation. Thus, depleted SAGD formations contain residual oil for EOR operations.

Figure 12:
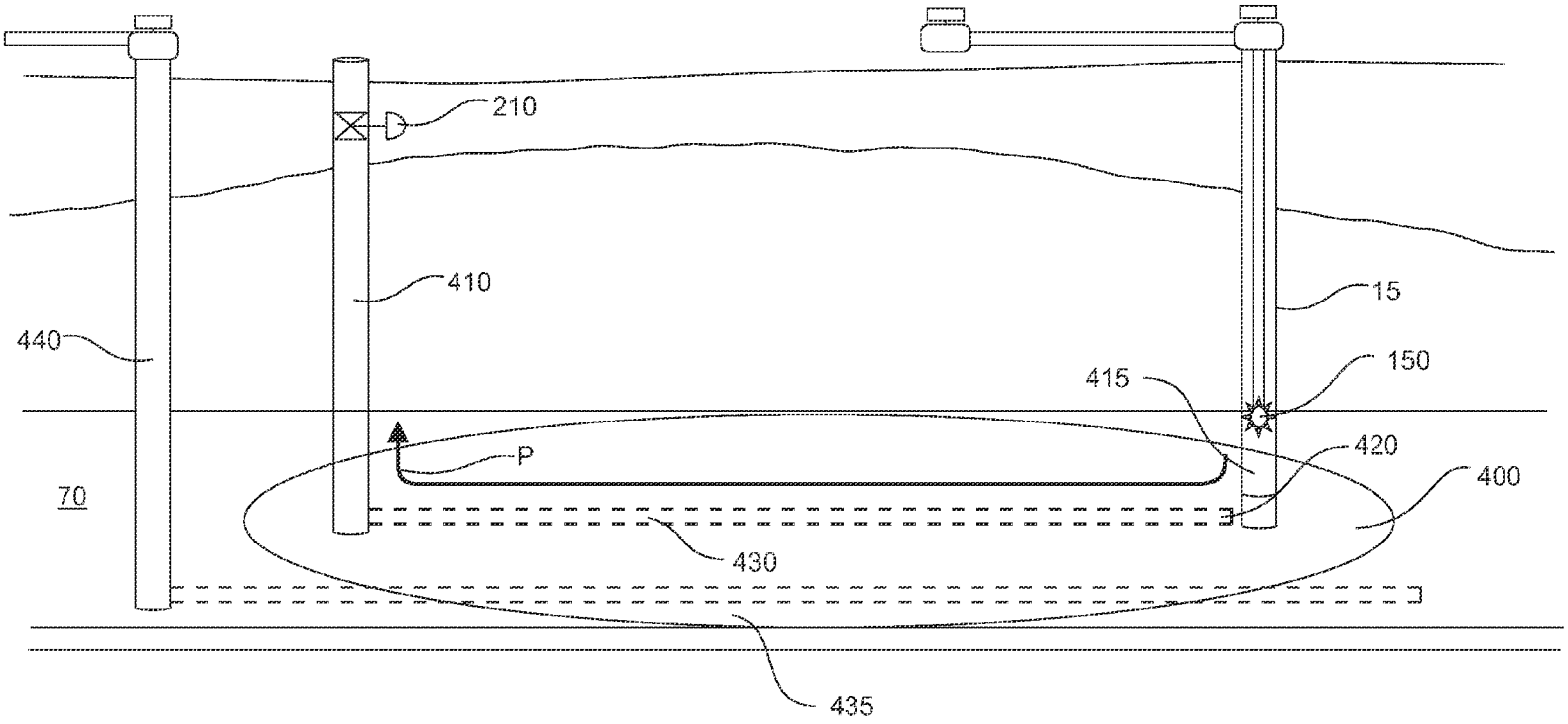
FIG. 12 illustrate a thermal well positioned at a toe of an injection well of a previously produced and depleted SAGD well-pair.

Accordingly, with reference to FIG. 12, alternate embodiments of the present invention can be employed to exploit the remaining 70% OOIP by using a thermal chamber 400 created during the previous SAGD operation and implementing a more aggressive EOR using the downhole burner 150.

As shown in FIG. 12, a new thermal well 15 utilizes the upper injection well 410 to gain thermal contact with residual heavy oil and/or bitumen left in the formation 70. Steam and hot flue gases, such as $CO_2$, are generated at a bottom 415 of the new thermal well 15, which can be directionally drilled to intersect a toe 420 of the upper injection well 410. The injection well 410 can now serves dual purposes: 1) providing tight pressure control by venting excess non-condensable gases that have collected in the thermal chamber 400 through the circulation path P; and 2) providing thermal energy, such as heat created by the downhole burner 150, access to the formation 70 for mobilizing the residual heavy oil and/or bitumen.

Steam and hot flues gases, generated by the downhole burner 150, flow through the horizontally-extending portion 430 of the injection well 410, conducting heat into the surrounding formation 70. The hot flue gases come into direct contact with the residual bitumen in the surrounding formation 70 for heating the residual bitumen while the steam condenses within the formation 70, releasing heat thereto to heat the residual bitumen.

Mass flow through the horizontally-extending portion 430 transports mass and convective heat that propagates the thermal chamber 400 into the surrounding formation 70 and the thermal energy is absorbed into the surrounding reservoir matrix as conductive heat for increasing formation and hydrocarbon temperatures. Bitumen mobility increases sufficiently enough to permit gravity drainage through the interstitial space of the formation 70, collecting at a bottom 435 of the thermal chamber 400 and permitting production thereof through the production well 440.

The temperatures on the outer extremity of the thermal chamber 400 gradually increase (pressure dependent) as $CO_2$ and conductive heat are absorbed into the liquid phase (oil-water-$CO_2$). The resultant emulsion drains downward along the outer walls of the thermal chamber 400 and accumulates around the lower production well 440 for production of additional oil from the depleted SAGD formation.

Example

Figure 13:
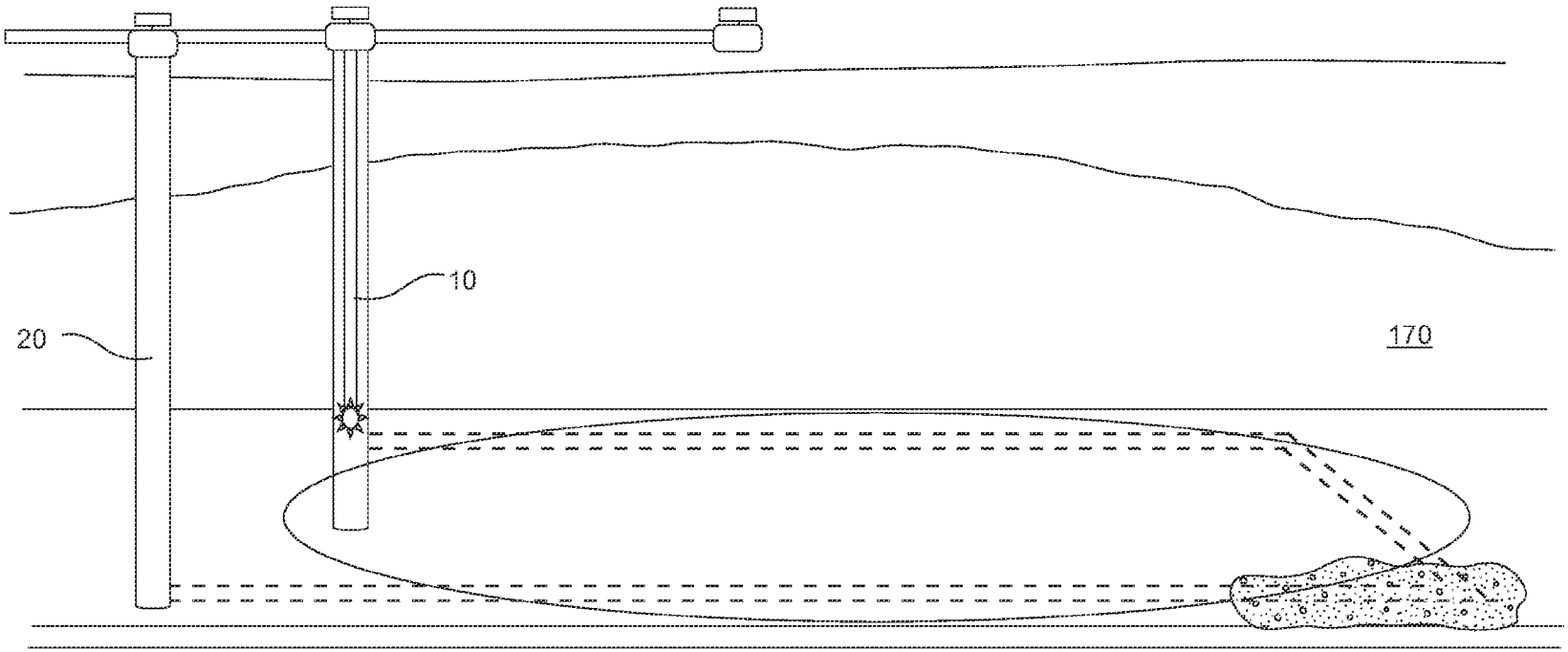
FIG. 13 illustrates an alternate arrangement of the injection well and the production well in a carbonate formation, a horizontally-extending portion of the injection well being positioned closer to the ceiling of a payzone-overburden interface.

Application of the embodiments described herein to certain hydrocarbon-bearing formations, such as carbonate reservoirs, can include alternate arrangements of the well-pairs as well-pair locations will depend on the hydrocarbon-bearing formation characteristics. For example, in carbonate reservoirs, such as the Grosmont Formations located at Saleski, Alberta, CANADA, and in one embodiment, the injection well 10 could be installed closer to existing caprock 170 or overburden to facilitate a top-down EOR drainage through vertical fractures (see FIG. 13)

One might increase the separation between the injection well 10 and production well 20 to facilitate carbonate exploitation on specific reservoirs having a caprock matrix. The objective of mobilizing bitumen from the top-down, or gas-drive gravity drain, can present certain thermal efficiency hurdles with an increase of thermal losses to the overburden. However, a high-pressure zone can be produced at the injection site above the production well 20 which can result in mobilized oil draining downwards in a gas drive form of scenario.

Figures 14, 15:
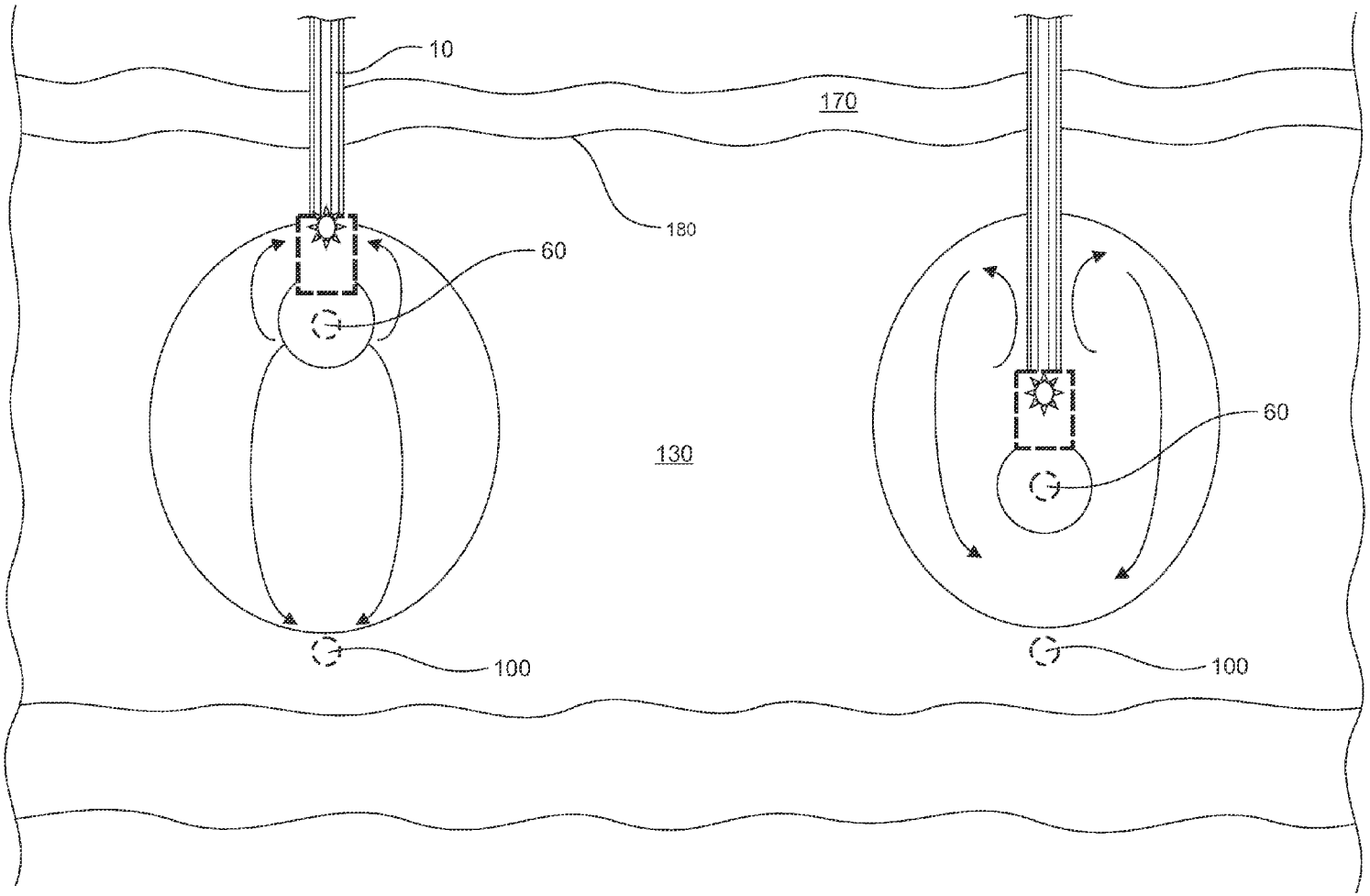
FIG. 14 illustrates a gas drive gravity drain process as applied to carbonate formations.
FIG. 15 illustrates a thermal siphon process as applied in a conventional SAGD formation.

With reference to FIGS. 14 and 15, the separation between the first horizontally-extending portion 60 of the injection well 10 and the second horizontally-extending portion 100 of the production well 20 can result in a shift in mechanisms for recovery of mobilized oil.

As shown in greater detail in FIG. 14, in a Top-Down EOR or Gas-Drive Gravity Drainage, the first horizontally-extending portion 60 of the injection well 10 is spaced away from the second horizontally-extending portion 100 of the production well 20, near a top 180 of the payzone 130 and adjacent to the caprock 170. Applicant believes that vertical fractures within the payzone 130 provide conduits for mobilized oil to drain downwards, creating the gas drive, towards the second horizontally-extending portion 100 of the production well 20. Locating the first horizontally-extending portion 60 of the injection well 10 about the top of the payzone adjacent the caprock 170 creates a high pressure zone above the production well 20. The method is believed to propagate near the caprock-payzone interface with $CO_2$ (a major component of the hot flue gases), solvent and convective heat. The hot flue gases are in direct contact with a caprock thief zone and tend to preferentially flow downwards through depleted fractures within the payzone 130.

As shown in greater detail in FIG. 15, in Bottom-Up EOR or a Thermal Siphon, the first horizontally-extending portion 60 of the injection well 10 is spaced closer to the second horizontally-extending portion 100 of the production well 20, near a middle of the payzone 130 and downhole from the caprock 170.

Applicant believes that with the injection well 10 positioned lower in the hydrocarbon-bearing formation 70, thermal losses to the overburden are reduced somewhat, and the process will be dependent on a thermal siphon effect, whereby hot flue gases flow upwards through the vertical fractures that have been produced and cycle back down through fractures further away from the heat source that are in the process of heating up and draining into the lower steam-solvent chamber.

It is believed that the vertical fractures within the payzone 130 provide conduits for hot flue gases to flow upwards and mobilized oil to drain downwards, creating a thermal siphon-gravity drainage movement of fluids. It is believed that the method propagates the payzone 130 with $CO_2$ (hot flue gases), solvent & convective heat. As the flue gases pass through the payzone 130, conductive heat transfer raises oil and rock temperatures while the cooled $CO_2$ gas goes into emulsion with the hydrocarbons or acts as voidage replacement within the payzone 130.

Figure 16:
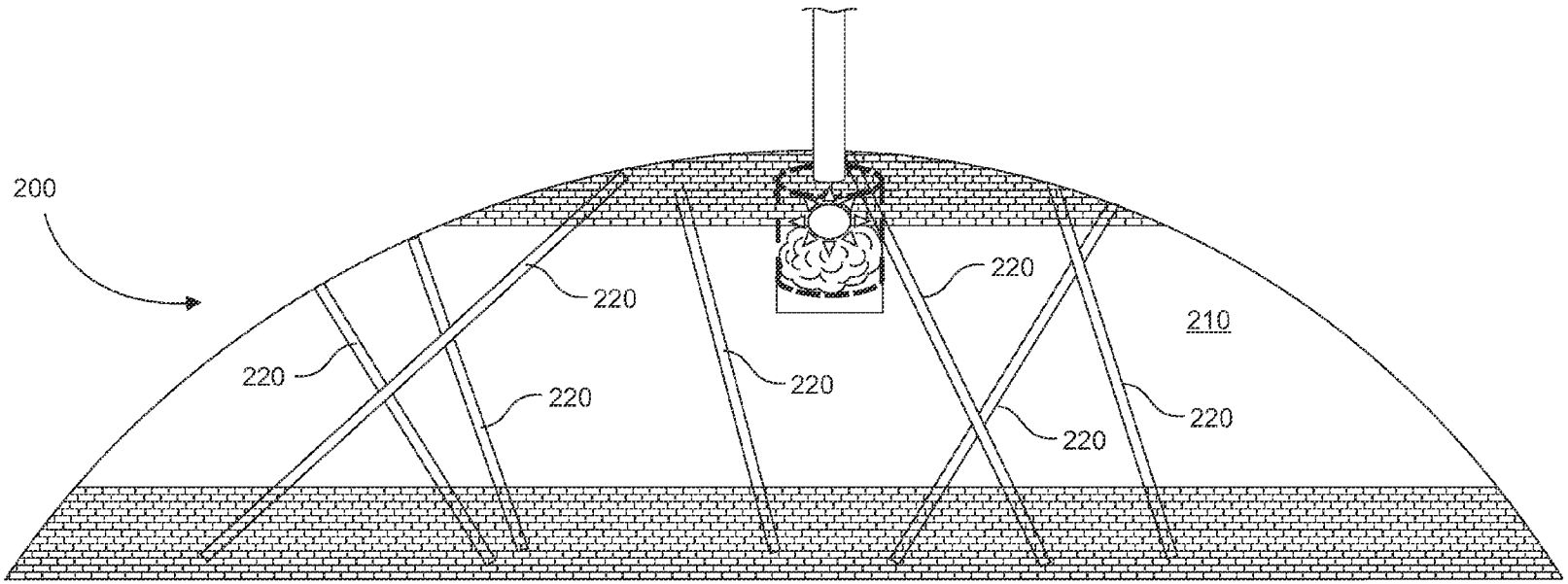
FIG. 16 illustrates fractures within a payzone of a carbonate reservoir for increasing permeability and mobilization of hydrocarbons about a downhole burner.

FIG. 16 illustrates a light oil recovery methodology particular to carbonate reservoirs 200 and the use of burner implementations of thermal EOR. Similar to the top-down gravity drive of FIG. 14, and enhanced by the interaction of flue gases and carbonates, a payzone 210 in a carbonate reservoir 200 can be positively affected, with higher permeability channels 220 being created. As stated, burner thermal processes, such as STRIP, can promote higher porosity within carbonate reservoirs. It is believed that when calcium bicarbonate comes into contact with $H_2O$ saturated with $CO_2$ it reacts to form soluble calcium bicarbonate. [$CaCO_3+CO_2+H_2O \rightarrow Ca(HCO_3)_2$]. Over time this reaction will cause the carbonate component of the structure to erode. This chemistry will expand and cause growth of existing fractures, while creating new high permeability channels 220 throughout the payzone 210. The thermal component creates an option of subjecting portions of a carbonate reservoir in close proximity to an injection well to high temperatures.

Although not shown in FIG. 16, a growing $CO_2$ gas cap at the injection well 10 provides a gas drive exploitation mechanism to mobilize oil downward toward the production well. Mobilized oil is swept downwards through the fractures, such as reef fractures, with steam and $CO_2$. The mobilized oil collects at the bottom of the pay zone where it is produced through the production well.

The embodiments of the invention for which an exclusive property or privilege is claimed are defined as follows:

1. A method for initiating steam assisted gravity drainage (SAGD) mobilization and recovery of hydrocarbons in a hydrocarbon-bearing formation comprising:

completing a SAGD well-pair into the formation, the well-pair having an injection well arranged generally parallel to, and spaced above, a production well, the injection well having a toe;

establishing a uni-directional thermal stimulation circulation path along the injection well by drilling an inter-well connection between the injection well and the production well;

circulating a thermal carrier having thermal energy between the injection well and the inter-well connection;

forming an initial thermal chamber along at least a portion of the injection well; and mobilizing the hydrocarbons for recovery from the production well.

2. The method of claim 1 wherein connecting the injection well to the inter-well connection comprises connecting the toe of the injection well to the production well.

3. The method of claim 2 wherein the circulation of the thermal carrier comprises introduction of the thermal carrier through the injection well.

4. The method of claim 1 wherein the circulating of the thermal carrier comprises introducing steam into the injection well.

5. The method of claim 1 further comprising generating steam in the injection well.

6. The method of claim 1, wherein drilling between the injection well and the production well further comprises when completing the SAGD well-pair, sloping the toe of the injection well downwards to intercept the production well or sloping a toe of the production well upwards to intercept the injection well.

7. The method of claim 1 further comprising completing a thermal well at or adjacent the toe of the injection well for forming the inter-well connection.

8. The method of claim 7, further comprising:

completing more than two or more SAGD well-pairs; and wherein completing a thermal well at or adjacent the toe of the injection well further comprises:

completing a thermal well generally about the toes of the injection wells of several of the more than two or more SAGD well-pairs for communication of the thermal carrier therebetween.

9. The method of claim 8, wherein circulating the thermal carrier further comprises:

operating a downhole burner for generating steam and hot, non-condensable gases;

circulating the steam and hot, non-condensable gases along the injection well, and venting non-condensable gases through the inter-well connection.

10. The method of claim 9 further comprising locating the downhole burner in the injection well.

11. The method of claim 9 further comprising locating the downhole burner in the thermal well.

12. The method of claim 2 wherein after establishing and forming an initial thermal chamber along at least a portion of the injection well, the method further comprising:

blocking the circulation path between injection well and the production; and establishing steady-state operations between the injection well and the production well.

13. The method of claim 1, wherein circulating the carrier further comprises:

operating a downhole burner for generating steam and hot, non-condensable gases;

circulating the steam and hot, non-condensable gases along the injection well, and venting non-condensable gases from the production well.

14. The method of claim 13, further comprising locating the downhole burner in the injection well.

* * * * *